US007690929B2

(12) United States Patent
Freimuth et al.

(10) Patent No.: US 7,690,929 B2
(45) Date of Patent: Apr. 6, 2010

(54) CONTACT APPARATUS FOR MINIMIZING THE LOAD OF MECHANICALLY LOADED SMT SOLDERED JOINTS

(75) Inventors: Michael Freimuth, Hirschau (DE); Siegfried Neumann, Kümmersbruck (DE); Christian Widmann, Poppenricht (DE)

(73) Assignee: Siemens Aktiengesellschaft, Munich (DE)

( * ) Notice: Subject to any disclaimer, the term of this patent is extended or adjusted under 35 U.S.C. 154(b) by 235 days.

(21) Appl. No.: 11/921,680

(22) PCT Filed: Jun. 1, 2006

(86) PCT No.: PCT/EP2006/062837

§ 371 (c)(1),
(2), (4) Date: Dec. 6, 2007

(87) PCT Pub. No.: WO2006/131489

PCT Pub. Date: Dec. 14, 2006

(65) Prior Publication Data

US 2009/0130869 A1 May 21, 2009

(30) Foreign Application Priority Data

Jun. 7, 2005 (DE) ..... 20 2005 008 923 U

(51) Int. Cl.
*H01R 12/00* (2006.01)

(52) U.S. Cl. ..... 439/76.1

(58) Field of Classification Search ..... 439/83, 439/78, 76.1, 709, 660
See application file for complete search history.

(56) References Cited

U.S. PATENT DOCUMENTS

| | | | | |
|---|---|---|---|---|
| 4,867,696 | A | 9/1989 | Demler, Jr. et al. | |
| 5,785,536 | A * | 7/1998 | McCartin et al. | 439/78 |
| 5,842,872 | A * | 12/1998 | Hosler et al. | 439/63 |
| 5,961,355 | A * | 10/1999 | Morlion et al. | 439/686 |
| 7,048,591 | B1 * | 5/2006 | Chiang | 439/709 |
| 2003/0224653 | A1 | 12/2003 | Wu | |
| 2006/0199439 | A1 * | 9/2006 | Mertz et al. | 439/709 |

FOREIGN PATENT DOCUMENTS

| | | |
|---|---|---|
| EP | 0 874 421 | 10/1998 |
| EP | 1 244 127 | 9/2002 |
| EP | 1 443 605 | 8/2004 |
| GB | 2 160 716 | 12/1985 |

* cited by examiner

*Primary Examiner*—Neil Abrams
*Assistant Examiner*—Phuong Nguyen
(74) *Attorney, Agent, or Firm*—Harness, Dickey & Pierce, P.L.C.

(57) ABSTRACT

At least one embodiment of the invention relates to a contact apparatus for SMT placement on a printed circuit board, the contact apparatus being provided for the electrically conductive connection to at least one conductor track on the printed circuit board. The contact apparatus includes a contact holder for accommodating the contact, and the contact of the contact apparatus is provided for the connection to at least one electrical mating contact. The contact apparatus is designed on an SMT basis and can therefore be produced inexpensively and fitted easily. According to at least one embodiment of the invention, the contact apparatus has a first housing part, the housing part having at least one elongate cutout for accommodating the contact holder, and at least one stop for the contact being integrally formed on the housing part, which stop is provided for the purpose of absorbing insertion forces when contact is made between the contact and an electrical mating contact.

24 Claims, 6 Drawing Sheets

CONTACT APPARATUS FOR MINIMIZING THE LOAD OF MECHANICALLY LOADED SMT SOLDERED JOINTS

PRIORITY STATEMENT

This application is the national phase under 35 U.S.C. § 371 of PCT International Application No. PCT/EP2006/062837 which has an International filing date of Jun. 1, 2006, which designated the United States of America and which claims priority on German Patent Application number DE 20 2005 008 923.0 filed Jun. 7, 2005, the entire contents of which are hereby incorporated herein by reference.

FIELD

At least one embodiment of the invention generally relates to a contact apparatus for SMT component application on a printed circuit board. For example, it may relate to one wherein the contact apparatus is provided for electrically conductive connection of at least one contact of the contact apparatus to at least one conductor track of the printed circuit board via at least one solder point, wherein the contact apparatus comprises a contact holder for receiving the contact, and wherein the contact of the contact apparatus is provided for connection to at least one electrical mating contact.

At least one embodiment of the invention furthermore generally relates to an SMT insertion connection having at least one such contact apparatus.

BACKGROUND

A contact apparatus for SMT solder points (surface mounting technology) is employed in the fabrication technology for printed circuit boards. SMT modules, which are also referred to as flat modules, require a high level of standardization which is made possible by high-quality fabrication and component application techniques. Any simplification, for example reducing the individual parts of the flat modules, is of great advantage.

In the past, SMT has gained more and more prominence over "through-hole technology" (THT) owing to simple fabrication, even though the strength of the SMT solder point is less by a factor of 5 to 10 than that of a THT solder point. On the other hand, SMT obviates holes in the circuit board and saves on at least one working step and elaborate soldering methods. A great disadvantage of SMT is that it is usually unsuitable for certain components, such as insertion connections or heavy components, for which a high mechanical load occurs on the solder points. For this reason the tried and tested, albeit more laborious, THT is nowadays often resorted to for heavy components and insertion connections as before.

Nevertheless, for certain problematic components it is possible to circumvent THT. SMT insertion connections, for example, which are intended to establish electrical contact of mating contacts (contacts outside the printed circuit board) with conductor tracks of the printed circuit board, require auxiliary designs in order to ensure stable anchorage on the printed circuit board. If such an auxiliary design is not available, then SMT insertion connections do not generally provide the required stability in order to absorb the mechanical load, or the flow of force cannot be dissipated to more stable components. In order to counter this problem, lug-like apparatuses which are aligned vertically to the printed circuit board as auxiliary designs, and are used to position the insertion connection, may simultaneously be used for absorbing the mechanical loads parallel to the printed circuit board. For this reason, an insertion connection is in general usually configured so that the movement of the insertion process is carried out parallel to the printed circuit board so as to relieve the load from the SMT solder points.

EP 0874421A1discloses a plug-in connector which can be connected mechanically and electrically to a printed circuit board via SMT solder points in one working step. Lugs, which are sunk into the printed circuit board and are used as mechanical protection, are provided on the plug-in connector in order to protect the SMT solder points. The insertion movement is carried out parallel to the printed circuit board and perpendicularly to the lugs—as described in the previous section.

US 2003/0224653 A1discloses an electrical connector, which comprises an insulating housing and can be installed on a printed circuit board. It has a series of terminals, which can be contacted by conductor tracks of the printed circuit board.

SUMMARY

At least one embodiment of the invention provides an SMT-based contact apparatus, which is both inexpensive to produce and simple to assemble.

A contact apparatus of at least one embodiment comprises a first housing part, the first housing part comprising at least one elongate recess for receiving the contact holder and at least one stop for the contact, which is provided for absorbing insertion forces when contacting the contact with an electrical mating contact, being formed integrally on the first housing part.

The object is furthermore achieved by an SMT insertion apparatus having the features specified in claim 20.

The mechanical load relief of the SMT solder points is achieved by a contact apparatus which diverts the flow of force. A flow of force, which is due for example to the insertion forces when contacting the contacts with the electrical mating contacts, is diverted by way of at least one stop on the first housing part. The first housing part thus absorbs damaging mechanical loads and transmits them to other housing parts and/or to the housing as a whole.

The flow of force begins primarily on the contacts, which are fixed in a contact holder by clamping. The contact holder constitutes the mechanical connecting element between the contacts and the first housing part. Owing to the fact that the contact is retained in the contact holder, and the contact holder is in turn retained in the housing part, the flow of force can be delivered from the contact via the contact holder to the first housing part, or from the contact directly onto the first housing part. In both cases the flow of force is kept away from the printed circuit board, and the SMT solder point as a potential transmitter of the flow of force is relieved of load.

The functionality of the SMT insertion connection is based on such a contact apparatus, the first housing part of the contact apparatus being designed so that it forms an accurately fitting insertion apparatus for a mating insertion apparatus, which is provided for contacting the contact with the electrical mating contact.

In an advantageous configuration of the contact apparatus, at least one stop for the contact is formed integrally on the first housing part and is provided for absorbing tensile and/or compressive forces which are exerted on the electrical mating contact. This prevents external forces from loading the SMT solder points.

It is possible to configure the contact apparatus as a module since the contact apparatus is connectable to further housing parts via the first housing part, and therefore permits universal use.

In an advantageous configuration of the contact apparatus, the first housing part is designed so that it forms an accurately fitting insertion apparatus for a mating insertion apparatus, which is provided for contacting the contact with the electrical mating contact. This makes it possible to use the contact apparatus as a plug-in mating part, for example, and to make or break the contacting simply and quickly.

In another advantageous configuration, the first housing part comprises a cover plate with at least one elongate recess, by which the frames of the contact holder are guidable and allow simple introduction into the fixing region. This saves on outlay and time for mechanized or manual component application.

In another advantageous configuration, the first housing part comprises side plates with at least one recess, by which at least the guide bars of the contact holder are guidable. These recesses are both used for simple introduction of the contact holder into the housing part and also, in combination with the spacer bars on the lower side of the cover plate, lead to more stable fixing of the contact holder in the vertical direction perpendicularly to the printed circuit board.

In another advantageous configuration, the side plates comprise recesses which are designed as a stop in an introduction region and as a groove in a fixing region. This combination makes it possible to introduce the frames of the contact holder into the elongate recesses of the cover plate, before the contact holder is fully fixed in the fixing region. This is a further apparatus for simplifying the introduction process.

In another advantageous configuration, finger protection elements are formed integrally on the upper side of the cover plate in the fixing region of the first housing part. These finger protection elements prevent undesired touching by the user when withdrawing or connecting the electrical mating contact. They furthermore prevent unintentional contacting with other metal parts, which could cause a short circuit, or contact by other objects or materials which could contaminate the contact in the long term. Optionally, it is possible to provide the finger protection elements as elements which form an accurately fitting insertion apparatus.

In another advantageous configuration, at least one fixing apparatus is provided for fastening the contact holder in the fixing region, in order to fasten the contact holder to the printed circuit board in the horizontal direction.

In another advantageous configuration, the contact is divided into various segments with different functions. The contact comprises a small protruding tip, which is provided as a contact point for soldering to the printed circuit board. The contact furthermore contains a contact body for connection to the electrical mating contact, which is formed flatly and with a large area. The contact body and the contact foot are optionally connected to a resilient conductive connection piece, which can absorb mechanical load.

In another advantageous configuration, the contact is provided for direct insertion and for simple fixing by clamping in the contact holder.

In another advantageous configuration, the contact holder comprises guide elements formed integrally on the contact holder on its lower side for accurately fitting placement of the contact holder in guide holes, which are provided in the printed circuit board according to the arrangement of the guide elements. This is intended to facilitate positioning of the contact apparatus on the printed circuit board. Optionally, it is possible to configure the guide elements as press-in pins.

In another advantageous configuration, the contact holder comprises at least one frame for the contact body on the upper side, which is used for guide purposes during the introduction process.

In another advantageous configuration, the contact holder comprises at least one recess on the lower side, which is provided for receiving the contact foot of the contact in the contact holder. In this way, the contact holder lies flatly on the printed circuit board.

In another advantageous configuration, an integral apparatus comprises the functional devices of the contact holder and of the first housing part, so that the number of constituents of the contact apparatus is reduced and/or the component application process is simplified.

In another advantageous configuration of an SMT insertion connection, the SMT insertion connection comprises an insertion connection part, including at least one electrical mating contact, for contacting with the contact of the contact apparatus, which allows uncomplicated, rapid and/or secure contacting via the insertion principle.

BRIEF DESCRIPTION OF THE DRAWINGS

The invention will be described and explained in more detail below with the aid of the example embodiments represented in the figures, in which.

DETAILED DESCRIPTION OF THE EXAMPLE EMBODIMENTS

Figure 1:
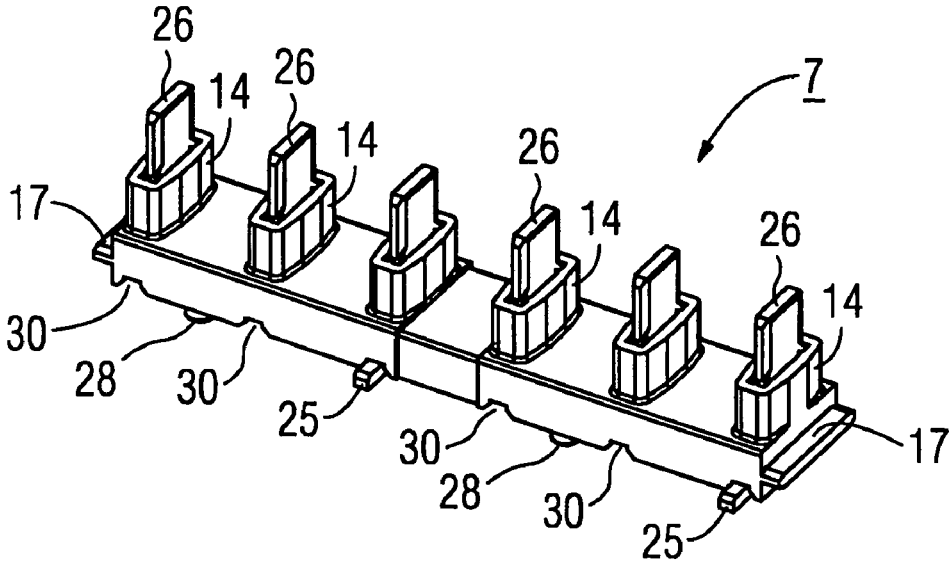
FIG. 1 shows a contact holder of a contact apparatus with contacts in a perspective view.
Figure 2:
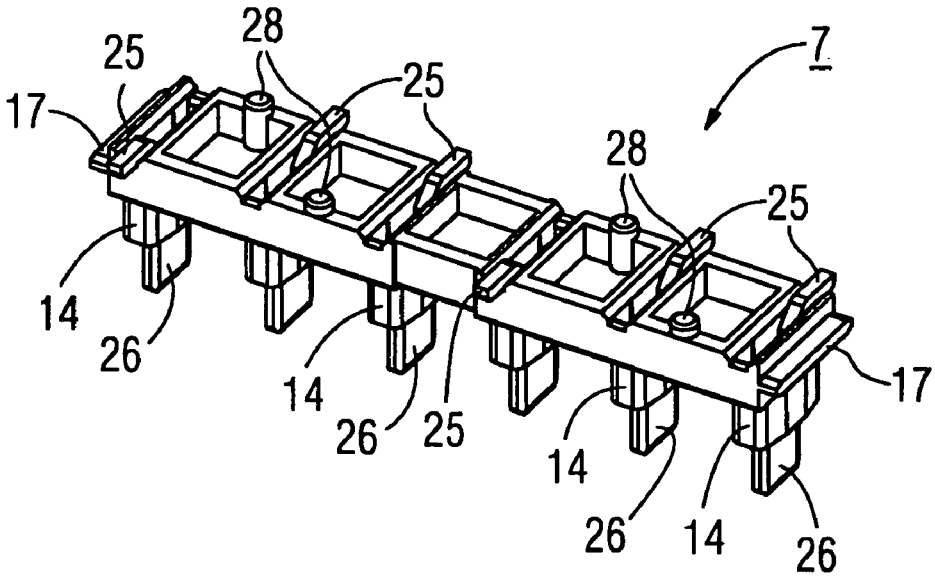
FIG. 2 shows the contact holder of FIG. 1 in another perspective view.

FIG. 1 shows a contact holder 7 of a contact apparatus 3 with contacts 5 in a perspective representation. The contact holder 7 carries six contacts 5 in the example embodiment, only parts of the contact 5 being visible in FIG. 1, namely a contact foot 25 and a contact body 26. The contacts 5 are fixed by clamping in frames 14 of the contact holder 7. Six recesses 30 are provided on the long front side of the contact holder 7, along the row of contacts 5, for the contact feet 25. With the aid of these recesses 30, it is possible to place the contact apparatus 3 flatly on the printed circuit board 4 even with the contacts 5 clamped in it. The contact apparatus 3 furthermore carries a guide 17 on the contact holder 7, or respectively on both short side surfaces. The guide bars 17 ensure problemfree introduction of the contact holder 7 into a first housing part 8. The introduction is represented by three introduction steps in FIGS. 4, 5 and 6. FIG. 2 shows the contact holder 7 of FIG. 1 in another perspective view, which makes it possible to see the lower side of the contact holder 7 that faces toward the printed circuit board 4. Besides the recesses 30 for the contact feet 25, the integrally formed guide elements 28 can also be seen, the number and shape of which may be adapted according to requirements.

Figure 3:
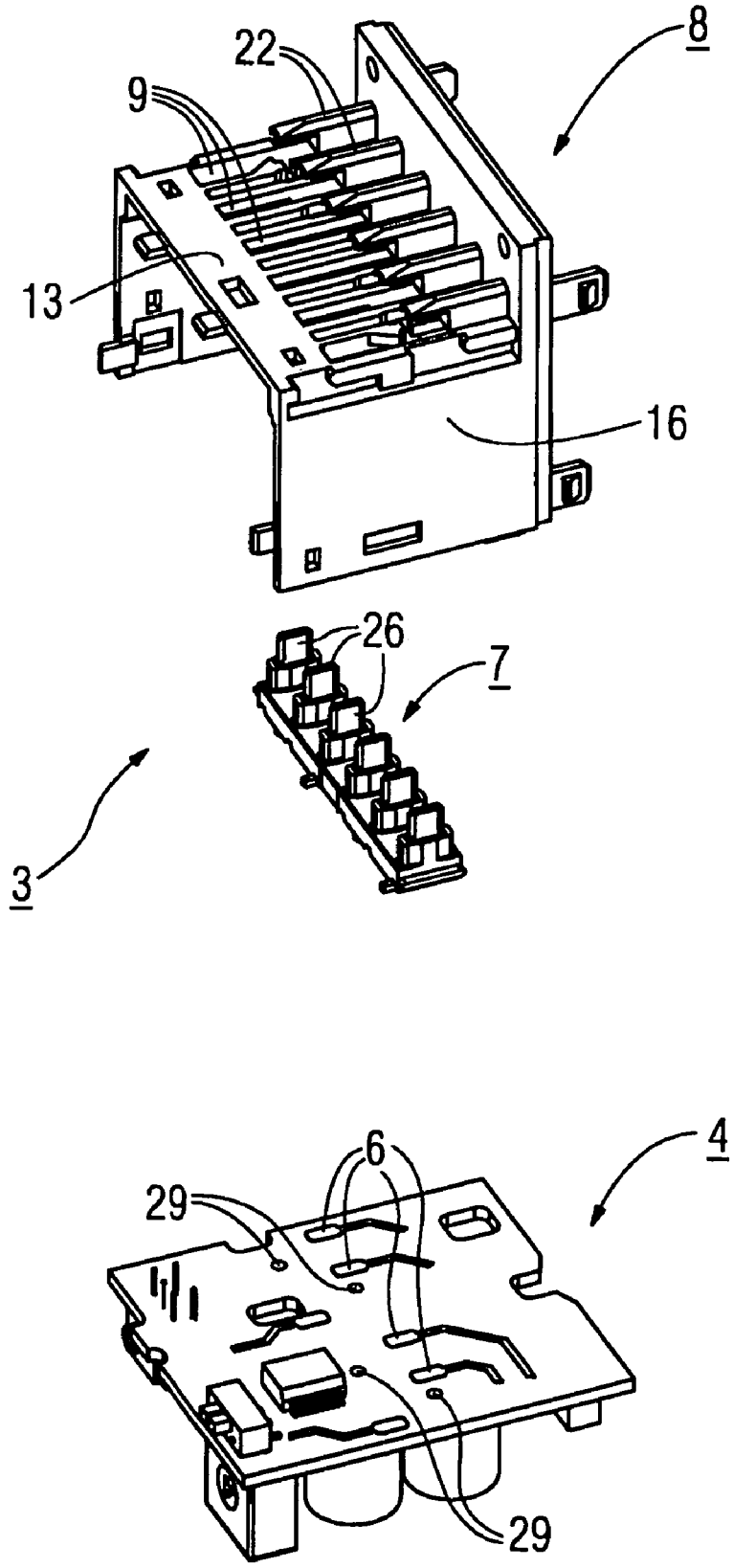
FIG. 3 shows a contact apparatus with a first housing part and a printed circuit board in an exploded representation.

FIG. 3 shows the contact apparatus 3 with the first housing part 8 and the printed circuit board 4 in an exploded representation. The printed circuit board 4 with guide holes 29 is at the bottom, on top of which lies the adapted contact apparatus 3 including the contact holder 7 with the contacts 5 and the device part 8. The contact apparatus 3 is provided for direct component application on the printed circuit board 4 by SMT technology and can be positioned directly on the printed circuit board 4 i.e. the contact feet 25 can be soldered directly. After soldering the contact feet 25, the integrally formed guide elements 28 of the contact apparatus 3 are also introduced into the guide holes 29 provided for them on the printed circuit board 4. The guide elements 28 may optionally be configured as press-in pins; a different number of guide elements 28 or guide holes 29 may also be envisaged. The first device part 8 is provided for guiding the contact apparatus 3 together with the printed circuit board 4 in the elongate recesses 9. The first housing part 8 is provided for protecting the contact apparatus 3 and/or allowing connection to further housing parts 11, 12 and/or forming an insertion connection for the contacts 5.

Figure 4:
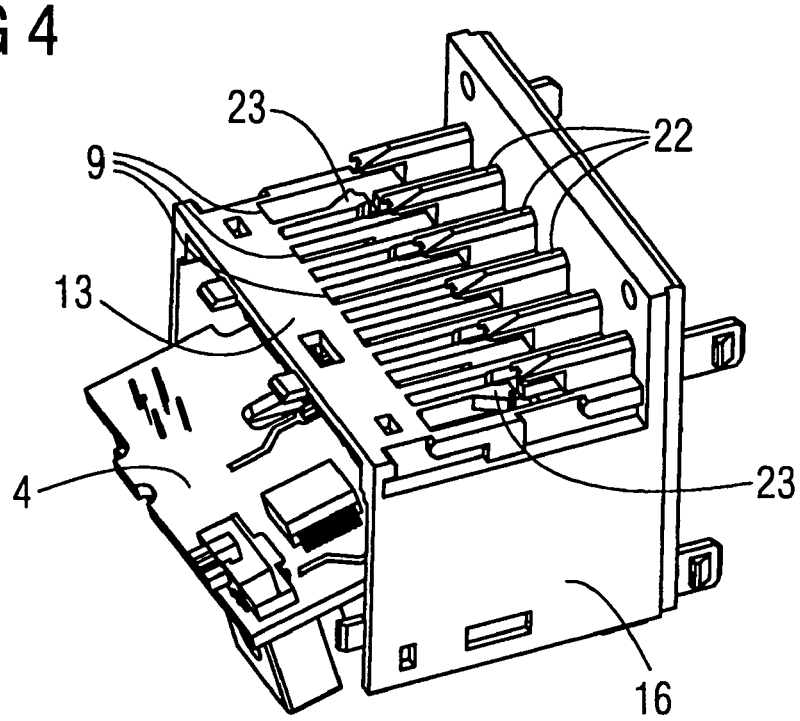
FIG. 4 shows a contact apparatus arranged on a printed circuit board during introduction into the first housing part.

FIG. 4 shows a contact apparatus 3 arranged on a printed circuit board 4 during introduction into the first housing part 8. This figure is to be considered in conjunction with FIG. 5 and FIG. 6, since these three figures show an image sequence of the process of introducing the contact holder 7 placed on the printed circuit board 4 into the first housing part 8. Each figure illustrates one of the three steps which are necessary in order to fix the contact apparatus 3, together with the printed circuit board 4, in the first housing part 8. In the first step, the contact apparatus 3 together with the printed circuit board 4 is pushed under a cover plate 13 of the first housing part 8 so that it is possible to introduce the frames 14 into the elongate recesses 9 of the first housing part 8.

Figure 5:
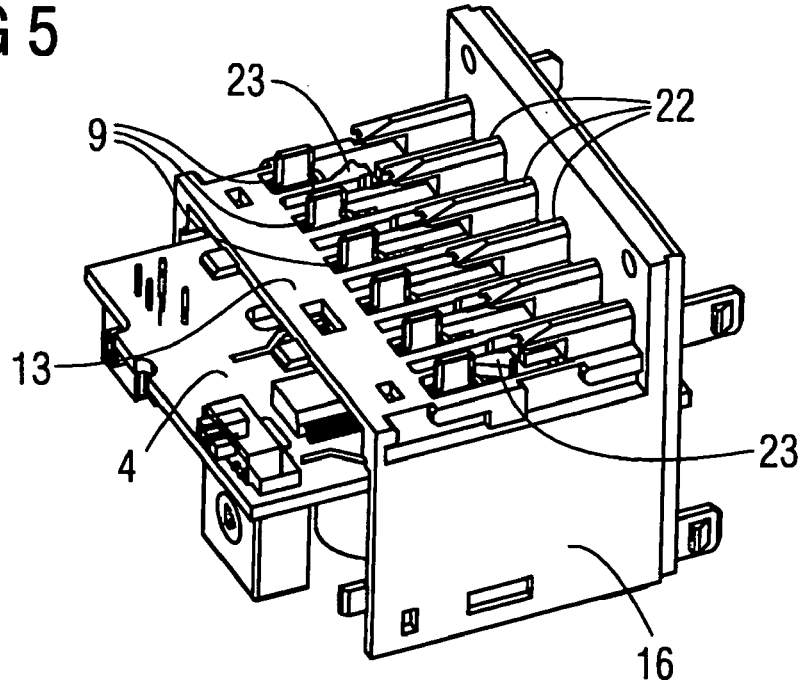
FIG. 5 shows a contact apparatus arranged on a printed circuit board during fixing in the first housing part.

FIG. 5 shows a contact apparatus 3 arranged on a printed circuit board 4 during fastening in the first housing part 8. In this second step the frames 14 are introduced into the elongate recesses 9, the printed circuit board 4 and the cover plate 13 being mutually parallel.

Figure 6:
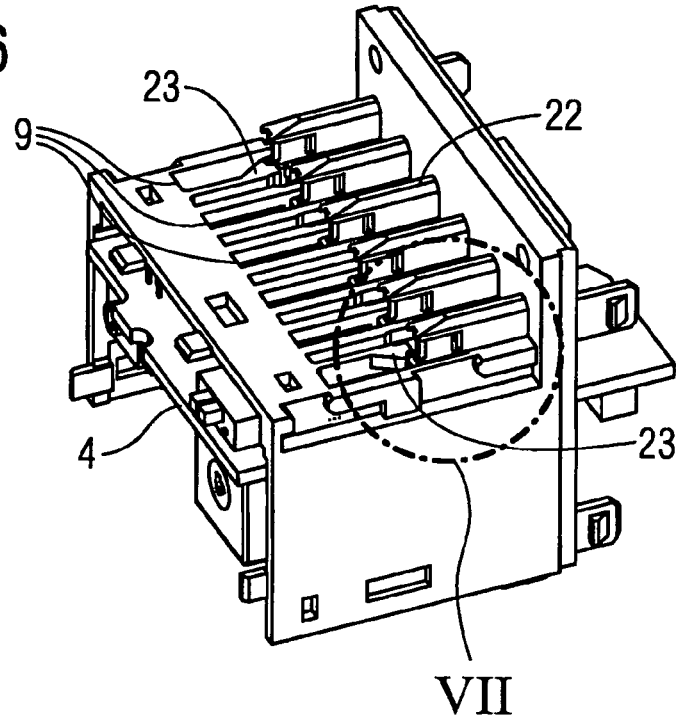
FIG. 6 shows a contact apparatus arranged on a printed circuit board in the fixed state in the first housing part.

FIG. 6 shows a contact apparatus 3 arranged on a printed circuit board 4 in the fixed state in the housing part 8. In this third step, the transition of the contact holder 7 placed on the printed circuit board 4 from the introduction region 18 into the fixing region 20 takes place. To this end a horizontal movement is carried out so that contact bodies 26 of the contacts 5 are placed under the finger protection elements 22. After the third step has been carried out, the contact holder 7 placed on the printed circuit board 4 is fixed in the housing part 8. The introduction process is concluded.

Figure 7:
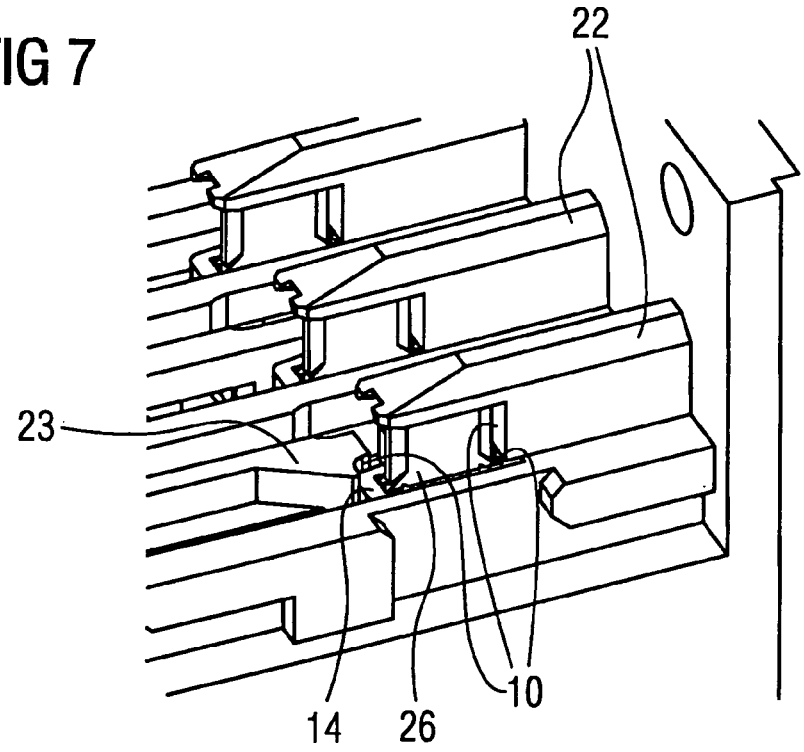
FIG. 7 shows a detail of FIG. 6 as an enlarged view of a retaining apparatus for fixing the contact holder in the cover plate of the first housing part.

FIG. 7 shows a detail of FIG. 6 as an enlarged view of a retaining apparatus for fixing the contact holder in the cover plate of the first housing part. This again shows in detail the way in which the contact body 26 is placed under the finger protection element 22. It can furthermore be seen that the contact apparatus 3 is retained on the frame 14 with the aid of the fixing apparatus 23. The retention functions according to the spring principle, and comes into effect when the frame 14 is moved from the introduction region 18 into the fixing region 20. The fixing apparatus 23 prevents the contact holder 7 placed on the printed circuit board 4 from returning into the introduction region 18. A possible movement vertically with respect to the cover plate 13 is furthermore prevented owing to the finger protection elements 22 and the guide bars 17. The contact apparatus 3 is therefore fully fixed and, for contacting the contact 5 with an electrical mating contact, requires an insertion apparatus part specially intended for this, since the contact body 26 is enclosed or protected on three sites.

Figure 8:
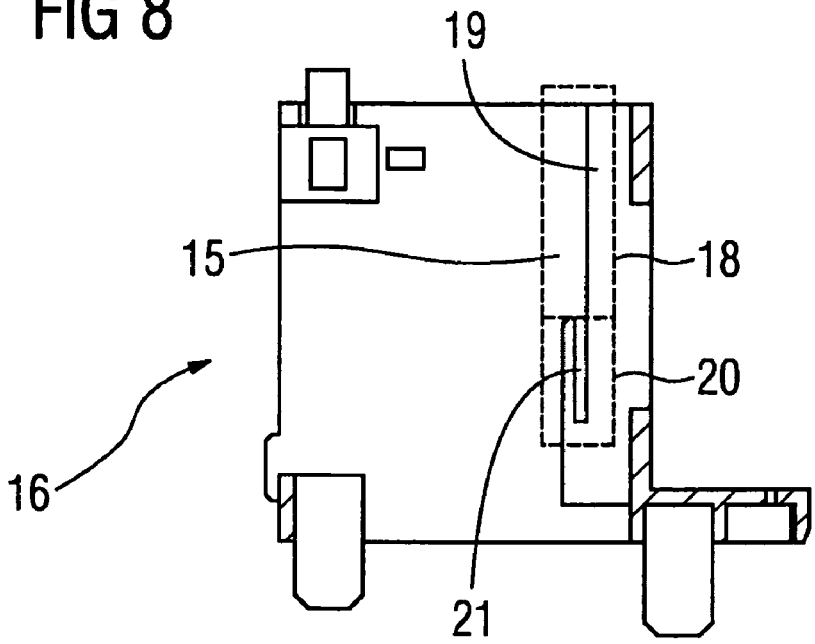
FIG. 8 shows a partly sectional view of a side plate of the first housing part to illustrate the introduction region and the fixing region of the contact apparatus.

FIG. 8 shows a partly sectional view of a side plate 16 of the first housing part 8 to illustrate the introduction region 18 and the fixing region 20 of the contact apparatus 3. In the introduction region 18, the guide stop 19 makes it possible for the contact holder 7 placed on the printed circuit board 4 to be brought into place and guided on one side. The groove 21 in the fixing region 20 makes it possible to fix the contact holder 7 in the vertical direction with respect to the printed circuit board 4 in combination with the guide bar 17, which is guided in the manner of a rail in the groove 21.

Figure 9:
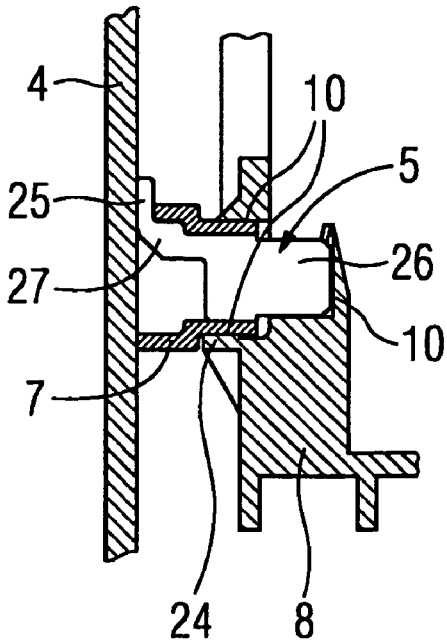
FIG. 9 shows a side view of the contact with its constituents inside the contact apparatus and FIG. 10 shows a perspective view of the contact apparatus inside a multi-part housing with a vertical section.

FIG. 9 shows a side view of the contact 5 with its constituents, namely the contact foot 25, a resilient connection piece 27 and the contact body 26. The contact 5 is shown on the printed circuit board 4, the contact foot 25 being soldered onto the printed circuit board 4. For reasons of stability, the contact holder 8 is placed flatly on the printed circuit board 4. The resilient connection piece 27 is provided for absorbing possible mechanical loads of the contact 5.

Figure 10:
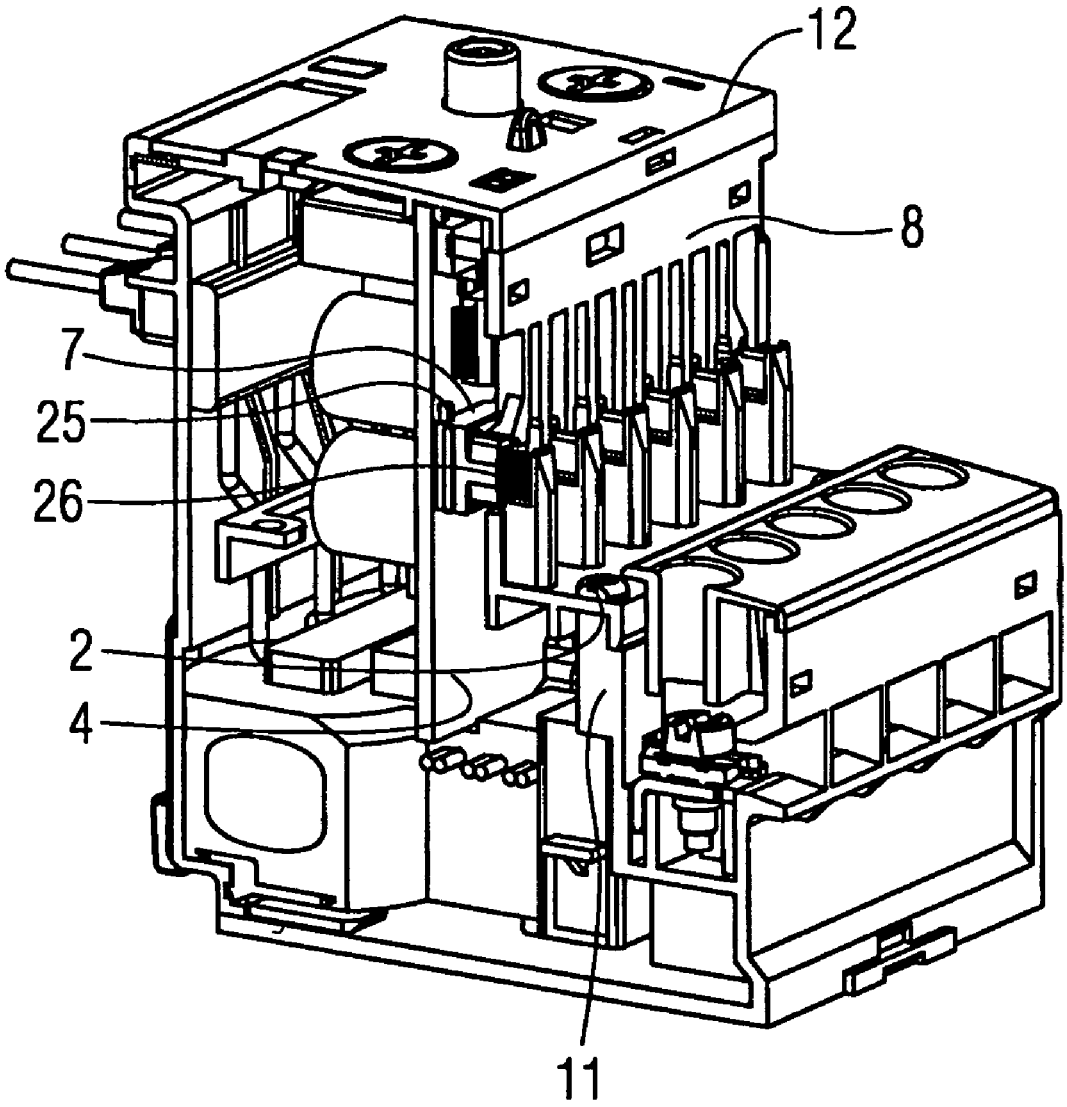

FIG. 10 shows a perspective view of the contact apparatus 3 inside a multi-part housing with a vertical section. In this figure, the contact apparatus 3 is integrated via the first housing part 8 into a housing with further housing parts 11, 12. In the exemplary embodiment, the second housing part 11 is connected to the housing part 8 by two screws. The housing part 12 is fitted on the device part 8 by means of latched fixing apparatuses. The vertical section makes it possible to see the positions of the printed circuit board 4 and of the contact holder 7 with the clamped contact 5.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A contact apparatus for SMT component application on a printed circuit board, comprising:

at least one contact to connect at least one electrical mating contact and to electrically connect to at least one conductor track of the printed circuit board via at least one solder point, a contact holder receiving the at least one contact;

a first housing part including at least one elongate recess to receive the contact holder placed on the printed circuit board; and at least one stopper that stops the at least one contact formed integrally on the first housing part to absorb insertion forces when contacting the at least one contact with an electrical mating contact.

2. The contact apparatus as claimed in claim 1, wherein the first housing part is connectable to further housing parts.

3. The contact apparatus as claimed in claim 1, wherein the first housing part is designed to form an accurately fitting insertion apparatus for a mating insertion apparatus, provided for contacting the at least one contact with the electrical mating contact.

4. The contact apparatus as claimed in claim 1, wherein the first housing part comprises a cover plate with the at least one elongate recess, by which frames of the contact holder are guidable.

5. The contact apparatus as claimed in claim 1, wherein a guide bar of the contact holder is guidable in the recess of a side plate of the first housing part.

6. The contact apparatus as claimed in claim 1, wherein the recess is designed as a guide stop in an introduction region and as a groove in a fixing region.

7. The contact apparatus as claimed in claim 1, wherein the first housing part is provided for covering and protecting the contact.

8. The contact apparatus as claimed in claim 1, wherein at least one finger protection element is formed integrally on an upper side of a cover plate in a fixing region of the first housing part.

9. The contact apparatus as claimed in claim 1, wherein at least one spacer bar is formed integrally on a lower side of a cover plate.

10. The contact apparatus as claimed in claim 1, wherein the at least one contact includes a contact foot for soldering to the printed circuit board and a contact body for connection to the electrical mating contact.

11. The contact apparatus as claimed in claim 1, wherein the at least one contact includes a resilient connection piece for connecting a contact foot to a contact body.

12. The contact apparatus as claimed in claim 1, wherein the at least one contact is provided for insertion and fixing by clamping in the contact holder.

13. The contact apparatus as claimed in claim 1, wherein the contact holder includes guide elements formed integrally on the contact holder on its lower side for accurately fitting placement of the contact holder in guide holes, provided in the printed circuit board according to the arrangement of the guide elements.

14. The contact apparatus as claimed in claim 1, wherein the contact holder includes at least one frame for a contact body on an upper side.

15. The contact apparatus as claimed in claim 1, wherein the contact holder includes at least one recess on a lower side, provided for receiving a contact foot of the contact in the contact holder.

16. The contact apparatus as claimed in claim 1, wherein the first housing part is connectable to further housing parts.

17. The contact apparatus as claimed in claim 1, wherein at least one fixing apparatus is provided for fastening the contact holder in a fixing region.

18. The contact apparatus as claimed in claim 1, wherein at least one finger protection element is provided for forming the accurately fitting insertion apparatus.

19. The contact apparatus as claimed in claim 1, wherein the stopper is provided for absorbing at least one of tensile and compressive forces which are exerted on the electrical mating contact.

20. An SMT insertion connection comprising at least one contact apparatus as claimed in claim 19.

21. The SMT insertion connection as claimed in claim 20, further comprising an insertion connection part, including at least one electrical mating contact, for contacting with the at least one contact of the contact apparatus.

22. An SMT insertion connection comprising at least one contact apparatus as claimed in claim 1.

23. The SMT insertion connection as claimed in claim 22, further comprising an insertion connection part, including at least one electrical mating contact, for contacting with the at least one contact of the contact apparatus.

24. The SMT insertion connection as claimed in claim 23, wherein the SMT insertion connection comprises an insertion connection part, including at least one electrical mating contact, for contacting with the contact of the contact apparatus.

* * * * *